United States Patent [19]

Wyner et al.

[11] 4,326,149

[45] Apr. 20, 1982

[54] ADAPTOR FOR HIGH INTENSITY ARC DISCHARGE LAMPS

[75] Inventors: Elliott F. Wyner, Peabody; Orville R. Burr, Beverly, both of Mass.; Robert L. Garrison, Henniker, N.H.

[73] Assignee: GTE Products Corporation, Stamford, Conn.

[21] Appl. No.: 189,550

[22] Filed: Sep. 22, 1980

Related U.S. Application Data

[63] Continuation of Ser. No. 808,126, Jun. 20, 1977, abandoned.

[51] Int. Cl.[3] ..... H05B 41/16

[52] U.S. Cl. ..... 315/289; 307/157; 315/57; 315/DIG. 7

[58] Field of Search ..... 315/51-53, 315/57, 58, 62, 71, 200 R, 289-291, DIG. 4, DIG. 7; 362/265; 339/278 L; 313/51; 336/105, 107; 307/157

[56] References Cited

U.S. PATENT DOCUMENTS

| | | | |
|---|---|---|---|
| 3,275,922 | 9/1966 | Meyer et al. | 315/200 X |
| 3,401,265 | 9/1968 | Dotto | 315/205 X |
| 3,466,500 | 9/1969 | Peek | 315/206 X |

FOREIGN PATENT DOCUMENTS

| | | | |
|---|---|---|---|
| 52-46686 | 4/1977 | Japan | 315/289 |

*Primary Examiner*—Eugene R. La Roche
*Attorney, Agent, or Firm*—James Theodosopoulos

[57] ABSTRACT

An adaptor for use with incandescent lamp sockets includes a circuit for igniting a high intensity arc discharge lamp and limiting the current flow thereto. The adaptor includes means for connecting to a source of electrical power and means for connecting to an incandescent lamp socket.

2 Claims, 3 Drawing Figures

ADAPTOR FOR HIGH INTENSITY ARC DISCHARGE LAMPS

This is a continuation, of application Ser. No. 808,126, filed June 20, 1977, now abandoned.

THE INVENTION

This invention is concerned with conserving energy by increasing the efficiency of incandescent lighting systems. The efficiency of incandescent lamps used for general illumination purposes is only about 12 to 20 lumens per watt. It is the purpose of this invention to provide an adaptor that permits use of high intensity arc discharge (HID) lamps with incandescent lamp sockets, the efficiency of HID lamps being much higher than that of incandescent lamps.

An adaptor in accordance with this invention contains means for connecting to a power line, means for connecting to an incandescent lamp socket and means for igniting an HID lamp and limiting the current flow thereto. The HID lamp is ignited by an electrical pulse, the voltage of which is sufficient for ignition but the energy of which is carefully controlled to that which can be safely withstood by usual incandescent lamp sockets over long life periods of time, without deleterious effect from the high voltage of the pulse.

In the drawing

Figure 1:
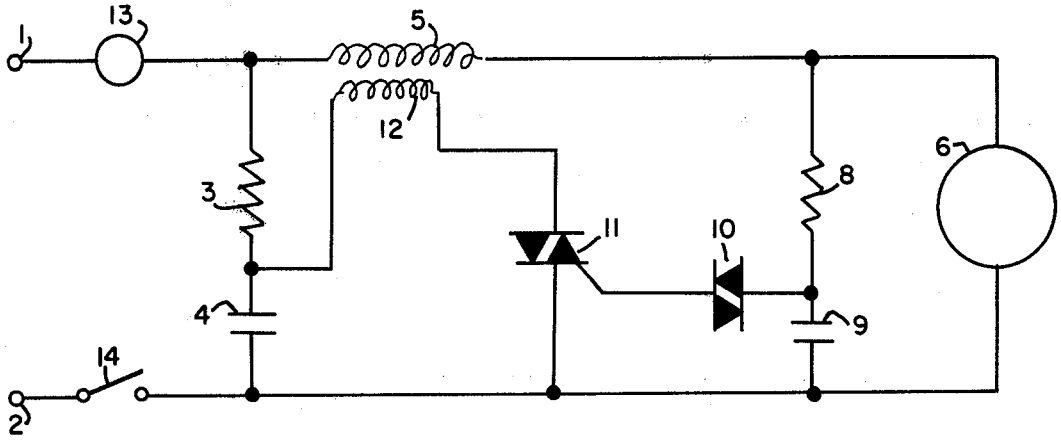
FIG. 1 is a schematic diagram of an adaptor in accordance with this invention.

The circuit of an adaptor in accordance with this invention, as shown in FIG. 1, comprises wires 1 and 2 for connection to a source of AC power. Connected across wires 1 and 2 are a resistor 3 and a capacitor 4. Also connected across wires 1 and 2 are an inductor 5 and a socket into which HID lamp 6 is inserted. In this example, inductor 5 is the secondary winding of a transformer. In parallel with lamp 6 is a resistor 8 and a capacitor 9. One side of a diac 10 is connected between resistor 8 and capacitor 9 and the other side of diac 10 is connected to the gate of a triac 11. Triac 11 is in series with primary 12 of the transformer, and triac 11 and primary 12 are in parallel with capacitor 4. A protective circuit breaker 13 and a switch 14 may be installed in the power input lines.

When switch 14 is closed, voltage from the power source is applied through current limiting inductor 5 and across both lamp 6 and the series combination of resistor 8 and capacitor 9. When sufficient voltage builds up across capacitor 9, diac 10 is fired which in turn triggers triac 11. Triac 11 then appears as a short circuit, allowing the charge on capacitor 4 to be discharged through primary 12. The induced EMF impressed on primary 12 is amplified by the turns ratio across secondary 5 and appears as a voltage spike to lamp 6. Resistor 3 prevents the power source from shorting through primary 12 when triac 11 is triggered. On each half cycle of the AC power source, the circuit is timed to produce one or more high voltage pulses to lamp 6. After lamp ignition, the voltage across capacitor 9 is insufficient to fire diac 10 and voltage pulses are not generated, except in the situation of a lamp operating at a higher then design voltage. In such a case, due to the phase differences involved, capacitor 4 is not heavily charged and a single very low voltage pulse, for example, about 5 volts, will occur on each half cycle.

In a specific example, inductor 5 was a choke having a trigger winding 12 and was constructed to deliver, with 120 AC volts input, 1.2 amperes to a resistor load having a voltage drop of 76 volts thereacross. The turns ratio between inductor winding (secondary) 5 and trigger winding (primary) 12 was 7 to 1.

Resistor 8 and capacitor 9 comprised a network which determined the firing time of diac 10, and therefore, of triac 11 and of the time of delivery of the pulse voltage to lamp 6. In this example, resistor 8 had a value of 68,000 ohms, capacitor 9 of 0.1 microfarad and the firing time was 90°, that is to say, one quarter of a cycle, which is when peak voltage occurs; for a 60 hertz power source, the firing time was about 4 milliseconds.

Diac 10 was type GT32 made by ECC Corp. and had a firing voltage of 27 to 37 volts. Triac 11 was type Q200E3, also made by ECC Corp.

Resistor 3 and capacitor 4 comprised an energy storage network and had values of 15,000 ohms and 0.047 microfarads respectively. Their values were such that capacitor 4 was approximately fully charged to peak AC line voltage at the tire of firing of diac 10 and triac 11, and also limited the energy delivered to the socket of lamp 6, for example, to socket 7 in FIG. 2 or to electrical outlet 15 in FIG. 3. On a 120 volt line, the ignition pulse delivered to the socket was about 1200 or 1300 volts and the energy thereof was less than about one millijoule.

An example of lamp 6 used with this invention was a high pressure sodium lamp having a base that would screw into an incandescent lamp socket. On a 120 volt power line, the input power to the adaptor was 66 watts, the input power to the lamp was 58 watts, the voltage across the lamp was 61 volts and the lamp output was 4180 lamps, equivalent to 63 lumens per watt.

Figure 2:
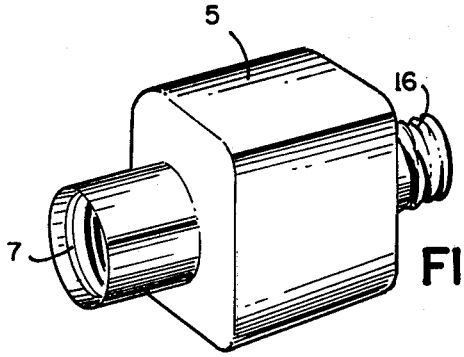
FIG. 2 shows one embodiment of such an adaptor.

The adaptor shown in FIG. 2 has an incandescent lamp base 16, for example, Leviton No. 165-1, at one end thereof for screwing into an incandescent lamp socket, as might be contained, say, in a ceiling fixture. At the other end of the adaptor is socket 7, for example, Leviton No. 3352-8, for screwing an incandescent lamp thereinto. The bulk of the adaptor comprises inductor 5 which, in this embodiment, is suitably encapsulated. The other electronic components of the circuit are contained within hollow base 16, the purpose being to separate them from the heat generated in inductor 5.

Figure 3:
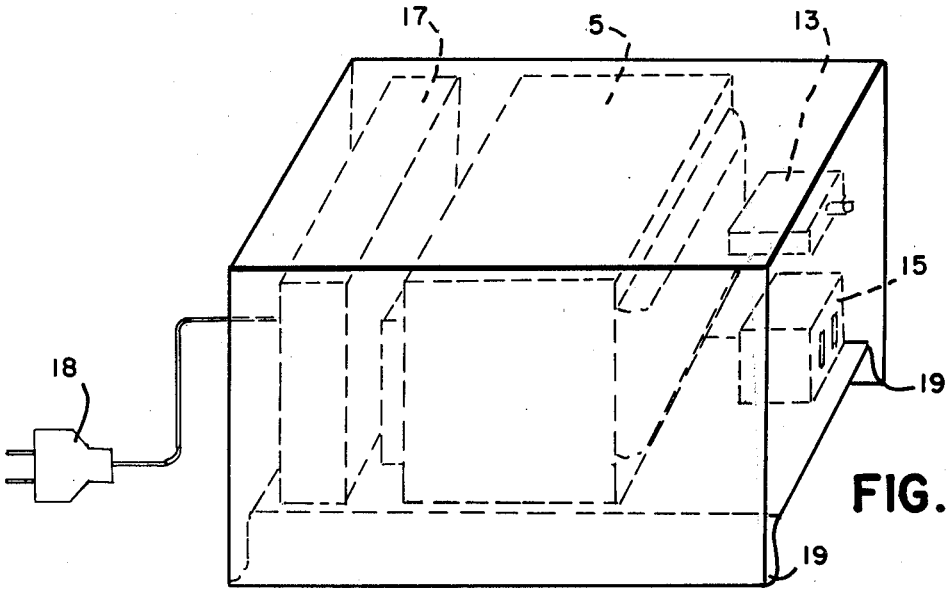
FIG. 3 shows another.

In the embodiment shown in FIG. 3, inductor 5 is positioned in about the center of the adaptor and the other electronic components are located at end section 17 of the adaptor. Circuit breaker 13 is located at the other end. The adaptor comprises an electrical plug 18 for plugging the adaptor into an electrical outlet, for example, a wall outlet, and has its own outlet 15 into which the plug of the cord of, say, a table lamp could be plugged. The adaptor rests on rails 19 to permit air circulation thereunder for cooling purposes. This type of adaptor is more suitable for table lamps since it does not make the lamp top heavy.

Typical incandescent lamp sockets in common usage have a rating of, for example, 660 watts, 250 volts. Since the ignition pulse is considerably higher than 250 volts, the energy of the pulse must be limited to that amount which will not adversely affect the life of such sockets.

The circuit of this invention could also be inserted into a standard electrical junction box which could be directly wired into, say, the ceiling of a building. A suitable socket would extend from the lower surface of the junction box into which an HID lamp 6 could be screwed.

We claim:

1. An adaptor for operation of a high intensity arc discharge lamp comprising: a housing containing an inductor having a trigger winding, an electronic circuit and an electrical outlet; an external electrical plug connected to said housing; said inductor being connected as a current limiting means between said electrical plug and outlet; the electronic circuit including a diac-triac condition and a resistor in series with a capacitor, one side of the diac being connected to the gate of the triac, the other side of the diac being connected to a point between the resistor and the capacitor; the triac being in series with the trigger winding; and said series resistor and capacitor being connected directly across said electrical outlet.

2. The adaptor of claim 1 including a second resistor in series with a second capacitor, the second resistor and second capacitor being connected directly across said electrical plug, and said trigger winding being series-connected between said triac and a point between said second resistor and second capacitor.

* * * * *